United States Patent [19]

Lee

[11] 4,322,178

[45] Mar. 30, 1982

[54] PAVEMENT PATCHING APPARATUS

[76] Inventor: Billy R. Lee, P.O. Box 8433, Charlotte, N.C. 28208

[21] Appl. No.: 125,990

[22] Filed: Feb. 29, 1980

[51] Int. Cl.[3] ..... E01C 19/00

[52] U.S. Cl. ..... 404/83; 37/DIG. 12

[58] Field of Search ..... 404/83, 109, 103, 127, 404/75, 72; 37/DIG. 12

[56] References Cited

U.S. PATENT DOCUMENTS

| | | | |
|---|---|---|---|
| 1,524,403 | 1/1925 | Merwin | 404/109 |
| 2,907,319 | 10/1959 | Love | 126/343.5 |
| 3,217,620 | 11/1965 | Mindrum | 404/103 |
| 3,584,547 | 6/1971 | Davin | 404/83 |
| 3,625,120 | 12/1971 | Nagy | 404/107 |
| 3,967,913 | 7/1976 | Gabriel | 404/109 |
| 4,072,435 | 2/1978 | Coho | 404/75 X |
| 4,100,688 | 7/1978 | Grist | 404/127 X |
| 4,215,949 | 8/1980 | Gabriel | 404/109 |

OTHER PUBLICATIONS

"Highway & Heavy Construction", Sep. 1977 Publication, pp. 30–33.

*Primary Examiner*—Nile C. Byers, Jr.

*Attorney, Agent, or Firm*—Richards, Shefte & Pinckney

[57] ABSTRACT

Self-propelled pavement patching apparatus is provided and includes a backhoe whose bucket has teeth and a cutting blade at opposite ends thereof and screeding edges underneath, another patch material distributing and screeding device mounted on the apparatus for movement therewith, a hopper for dispensing patch material to a conveyor for selective delivery of patch material to the backhoe or the screeding device. The apparatus is tricycle-type having two wheels at the outside and a third wheel for driving and steering. A roller adjacent one side wheel provides for compacting patching material over pavement defects, and the roller is lowered to raise that wheel from the pavement to form an outrigger corresponding to a conventional outrigger foot adjacent the other outside wheel. A movable outer hopper wall can be lowered for reception of patch material from a dump truck and raised toward a more nearly upright position to facilitate delivery of patching material to the conveyor and for towing vehicle clearance. The hopper is expansible widthwise of the apparatus, and an extensible guide provides a pendent arm contacting the pavement for viewing by the apparatus operator over the hopper for accurately locating the apparatus relative to pavement features. A towing link pivotably mounted adjacent the drive wheel has a towing eye for engagement with a hitching hook on a truck and is pivotable downwardly after engagement for lifting the drive wheel from the pavement for towing the apparatus behind the truck.

11 Claims, 6 Drawing Figures

PAVEMENT PATCHING APPARATUS

BACKGROUND OF THE INVENTION

A number of pavement patching machines or vehicles for utility use in patching small pavement defects have been disclosed in the prior art. It is not believed that any such machinery has found any general popularity, in spite of the fact that such patching is a pressing and often neglected problem due to recent bad winter weather, rapidly increasing costs of repair work, and shortages of people willing to perform such work. Eleven man repair crews are typically used for such repairs, using miscellaneous hand tools, as well as powered devices for separately and independently preparing pavement defects for repair, supplying asphalt patching material, distributing and leveling the patch material over a defect, and rolling, tamping or otherwise compacting the patch material into and over the pavement defect.

U.S. Pat. No. 3,217,620 discloses the most complete pavement patching equipment found in the prior art, and appears to be a large over-the-road vehicle which combines means for preparing pavement defects for repair, receiving, storing, and distributing patch material to a pavement defect, means for compacting patch material by rolling or tamping, and a brush for sweeping the pavement clean. This patent does not appear to disclose any means for screeding the loose patching material over the pavement defect before compacting, and the routing tools provided for defect preparation may present problems as to cleaning loose, defective paving material from a defect after its preparation for repair, and therefore a sizable air compressor is provided for delivering an air blast to a prepared pavement defect to clear it of all loosened debris.

U.S. Pat. No. 3,625,120 also discloses an over-the-road vehicle equiped with hopper means for reception, storage, and dispensation of patching material to a pavement defect. However, this machine has only a hydraulically operated rake for rearranging patch material in and over a pavement defect, and provides no tool for preparing the defect for receipt of the patch material. A roller is also provided for compacting the patching material. This machine would appear to be less useful and versatile than that of U.S. Pat. No. 3,217,620.

U.S. Pat. No. 3,967,913 and 2,907,319 appear to be more concerned with the heating, distribution, and oiling of patch material, the former disposing a tamping tool only and the latter disclosing no tools at all.

All of the devices disclosed in the prior art seem to show a need for a versatile, efficient pavement patching apparatus, but no such apparatus is known to be in general use. The apparatus of the present invention appears to overcome many shortcomings of the prior art by combining the best of defect repair tools, patching mateiral storage hoppers, and patching material delivery, distribution, and compacting means. At the same time the present invention provides an ideal combination of mobility and maneuverability for patching and moving from one defect to the next, while providing for easy transport by towing to individual job sites.

SUMMARY OF THE INVENTION

Briefly described the pavement patching apparatus of the present invention is movable to locations for repairing pavement defects adjacent such locations, and the apparatus includes hopper means for containing a supply of patching material, backhoe means mounted on the apparatus and having a bucket, and means for operating the backhoe means to manipulate the backhoe bucket to position it selectively at the hopper means and at pavement defects, to manipulate the backhoe bucket at pavement defects for working on them in preparation for receipt of patching material, to position the bucket to receive patching material from the hopper, and to manipulate the bucket to dispense patching material therefrom onto prepared pavement defects. The bucket has a blade element located adjacent its closed end and connected thereto for working on pavement defects, and the bucket also has at least one screeding edge extending generally from the closed end to the open end along the underside of the bucket for use in leveling off patching material dispensed to the prepared pavement defects. The hopper means includes a portion for storage of the supply of patching material and conveyor means for transporting the patching material from the storage portion for use in repairing pavement defects.

Preferably, the patching apparatus includes screeding means supported thereon for movement thereby for leveling off patching material over pavement defects, and the conveyor means is moveable between positions for feeding patching material selectively into the backhoe bucket and the screeding means. The hopper preferably has a movable outer wall for lowering to a suitable location for reception of patching material from a dump truck and for raising to a location suitable to facilitate delivery of the patching material onto the conveyor. Preferably the patching apparatus includes outrigger means, a roller for compacting patching material over pavement defects, and wheels for moving the apparatus to the locations for repairing pavement defects, the outrigger means including a movable pavement-engaging foot and means for lowering the foot adjacent one of the wheels for lifting the wheel from the pavement and means for lowering the roller into pavement engagement position adjacent another of the wheels for lifting it from the pavement.

The preferred embodiment of the present invention provides at least three wheels for moving the apparatus to the locations for repairing pavement defects and a towing link pivotably mounted at one end thereof to the apparatus adjacent to one of the wheels, the link having at the other end thereof an eye for engagement with a trailer hitching hook on a truck, the link being pivotable upwardly to a location for convenient engagement of the eye with the hook while the one wheel rests on the pavement and being pivotable downwardly after such engagement for lifting the one wheel from the pavement for towing the apparatus behind the truck. Also, the hopper is expansible widthwise of the apparatus beyond the normal road transport width thereof for secure receipt of patching material from a dump truck. Further, it provides a work position for an apparatus operator, where an operator normally sits and operates a steering wheel and other controls for the apparatus, the hopper being located to the rear of the operator; and it also provides an extensible guide mounted on the apparatus for extension rearwardly and widthwise of the hopper beyond the main portion of the apparatus for visibility by the operator over the hopper, the guide having a depending arm for contact with the pavement so that the operator is enabled to position the apparatus consistently relative to a pavement feature such as a curbing.

DESCRIPTION OF THE PREFERRED EMBODIMENT

Figure 1:
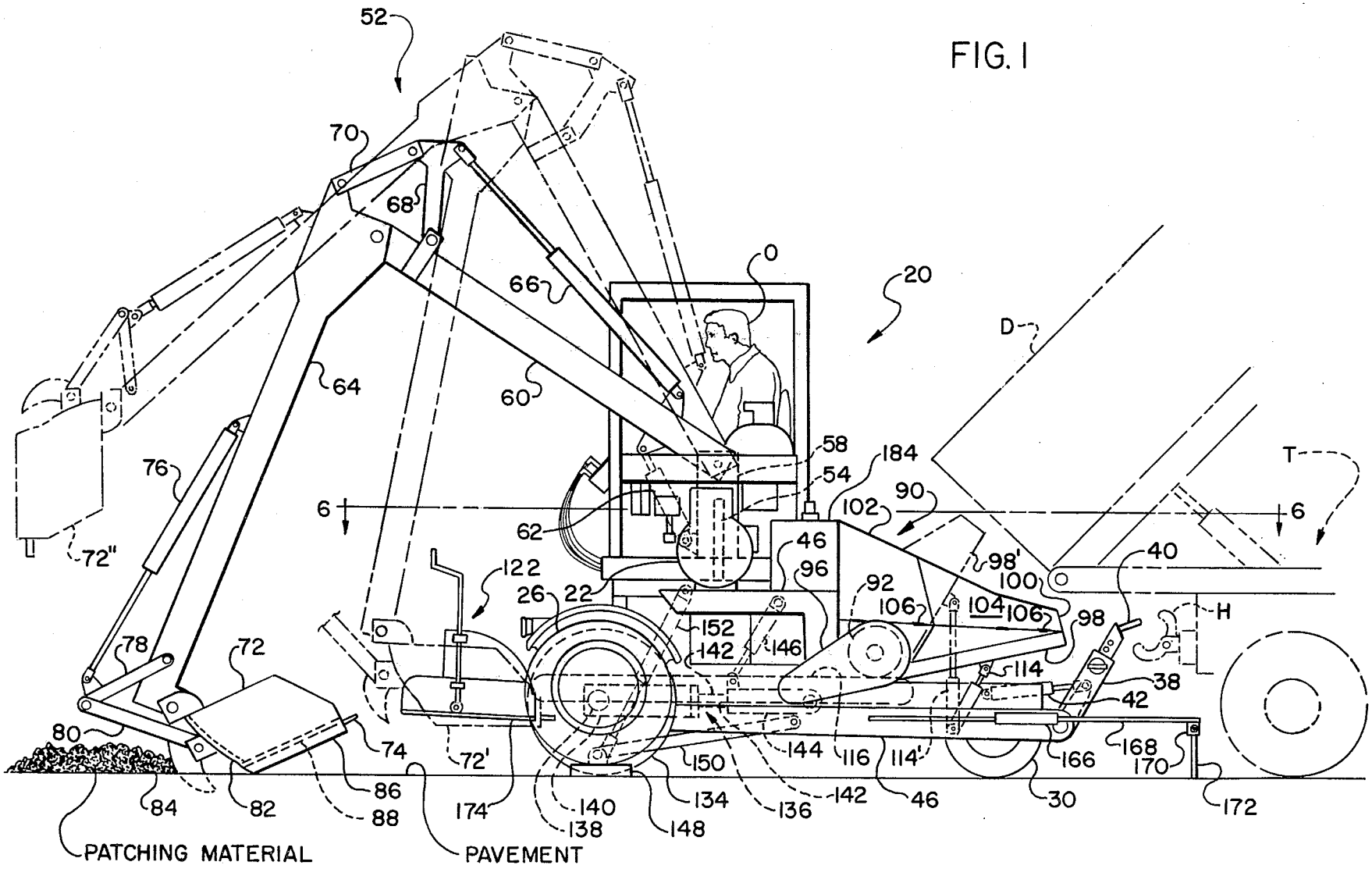
FIG. 1 is a left side elevational view of the pavement patching apparatus of the present invention, showing several possible positions of the backhoe, and showing the outrigger means engaged with the pavement.
Figure 2:
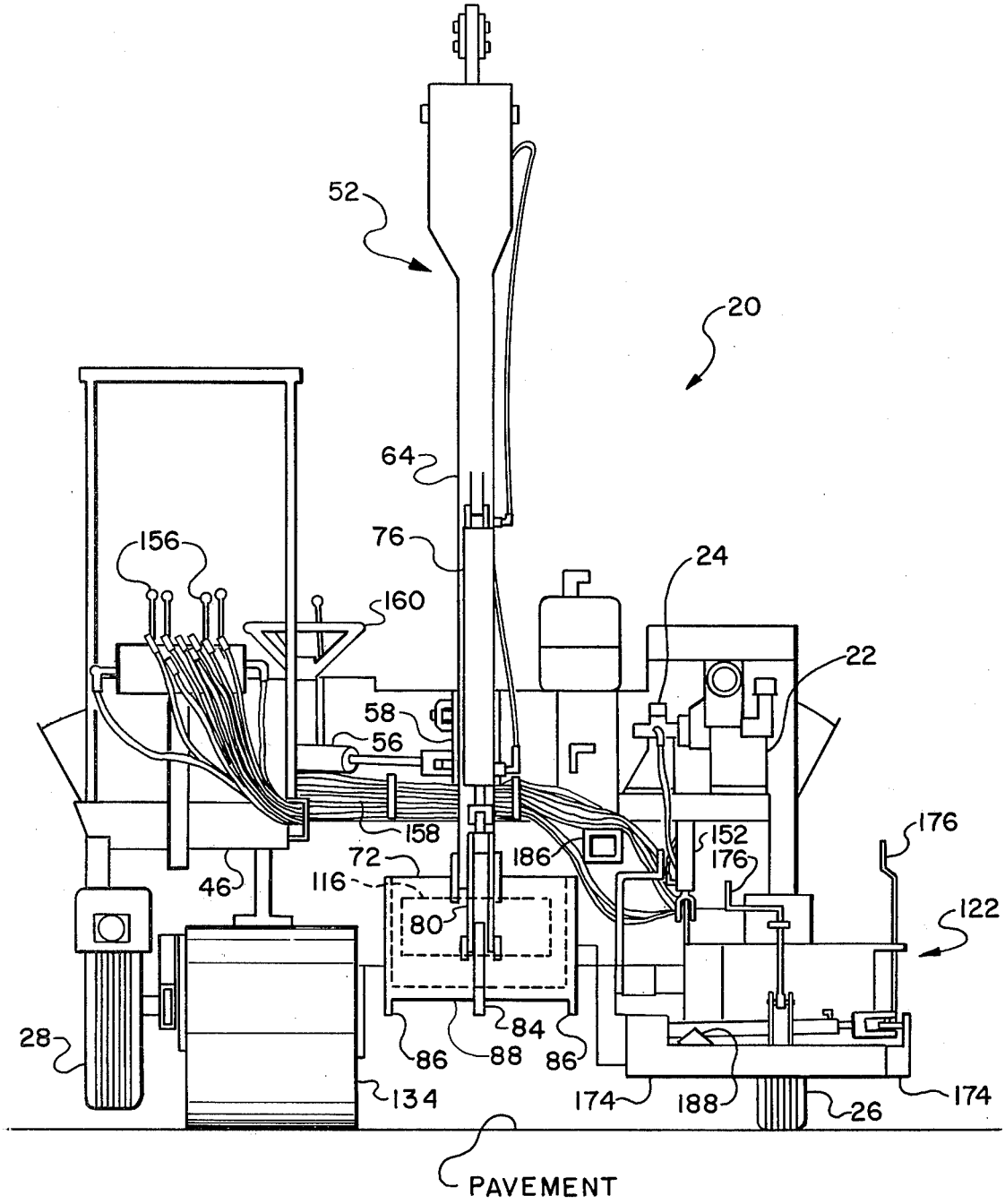
FIG. 2 is a front elevational view of the pavement patching apparatus, showing the roller lowered for compacting patching material.

The present invention provides a tricycle-type pavement patching apparatus 20 having a gasoline engine 22 connected to a hydraulic pump 24 for supplying hydraulic power for the various powered functions of the apparatus which will be described hereinafter.

Two of the tricycle wheel elements 26 and 28 are mounted on the apparatus at the left and right extremities thereof on the front or working end of the apparatus, and are free rotating. The third wheel element 30 is a dual wheel suitably mounted at the rear or hopper end of the apparatus 20 and is driven by a hydraulic motor 32 mounted to the steering frame 34 (on which the wheel element 30 is mounted) through a chain drive 36. A towing link 38 is pivotably mounted at one end thereof at the rear of the steering frame 34, and has an adjustably extending tow eye 40 at the other end thereof. A hydraulic cylinder 42 is connected to the link 38 and holds the link 38 in an upper, retracted position when the piston rod of the cylinder 42 is retracted. When the piston rod is extended, the link 38 is moved to a lower, extended position for engaging a towing hitch hook H mounted at the rear of a truck or tractor T, and by its unfolding from its partially-jackknifed inoperative position raises the third wheel element 30 from the ground or pavement on which it normally rests, thereby placing the weight of the rear end of the apparatus 20 on the tow hitch hook H, thereby readying the apparatus 20 for towing by the truck T. A hydraulic steering cylinder 44 extends from the frame 46 of the apparatus 20 to a pivotable connection 48 with the steering frame 34 for turning the steering frame 34 about a steering pivot 50.

Backhoe means 52 is mounted to the frame 46 for swinging about vertical axis at a pivot member 54 (on which is mounted a base 58 for the backhoe means 52) under power from a hydraulic cylinder 56 which serves as an extensible power link between the frame 46 and the base 58 for the backhoe means 52. The base 58 carries at its upper end a boom 60 pivotably mounted thereon for movement in a vertical plane under power from a lifting cylinder 62 which forms a powered expansible link between the base 58 and the boom 60. A dip stick 64 is pivotably mounted at the extending end of the boom 60 for movement in a vertical plane under power from a hoeing cylinder 66 through a crank arm 68 and a drag link 70. The dip stick 64 normally extends downwardly from its connection with the boom 60 and carries at its extending end a backhoe bucket 72 pivotably connected thereto. The bucket 72 has teeth 74 conventionally fixed at the open end thereof and at its closed end 82 is conventionally pivotably connected to the dip stick 64 for movement in a vertical plane under power from a bucket cylinder 76 which is linked to the closed end of the bucket 72 by a crank arm 78 pivotably mounted adjacent the extending end of the dip stick 64 and a bucket tilting link 80 which is pivotably connected to the extending end of the arm 78 and to the closed end 82 of the bucket 72 intermediately of the end 82. A hawk bill blade element 84 is affixed to the link 80 adjacent its pivotable connection to the bucket 72 and extends downwardly therefrom for cutting into the pavement when the bucket 72 is positioned with its open end tilted upwardly as shown in solid lines in FIG. 1.

Screeding edges 86 extend below and alongside the underside 88 of the bucket 72 extending generally from the closed end 82 to the open end thereof.

Figure 3:
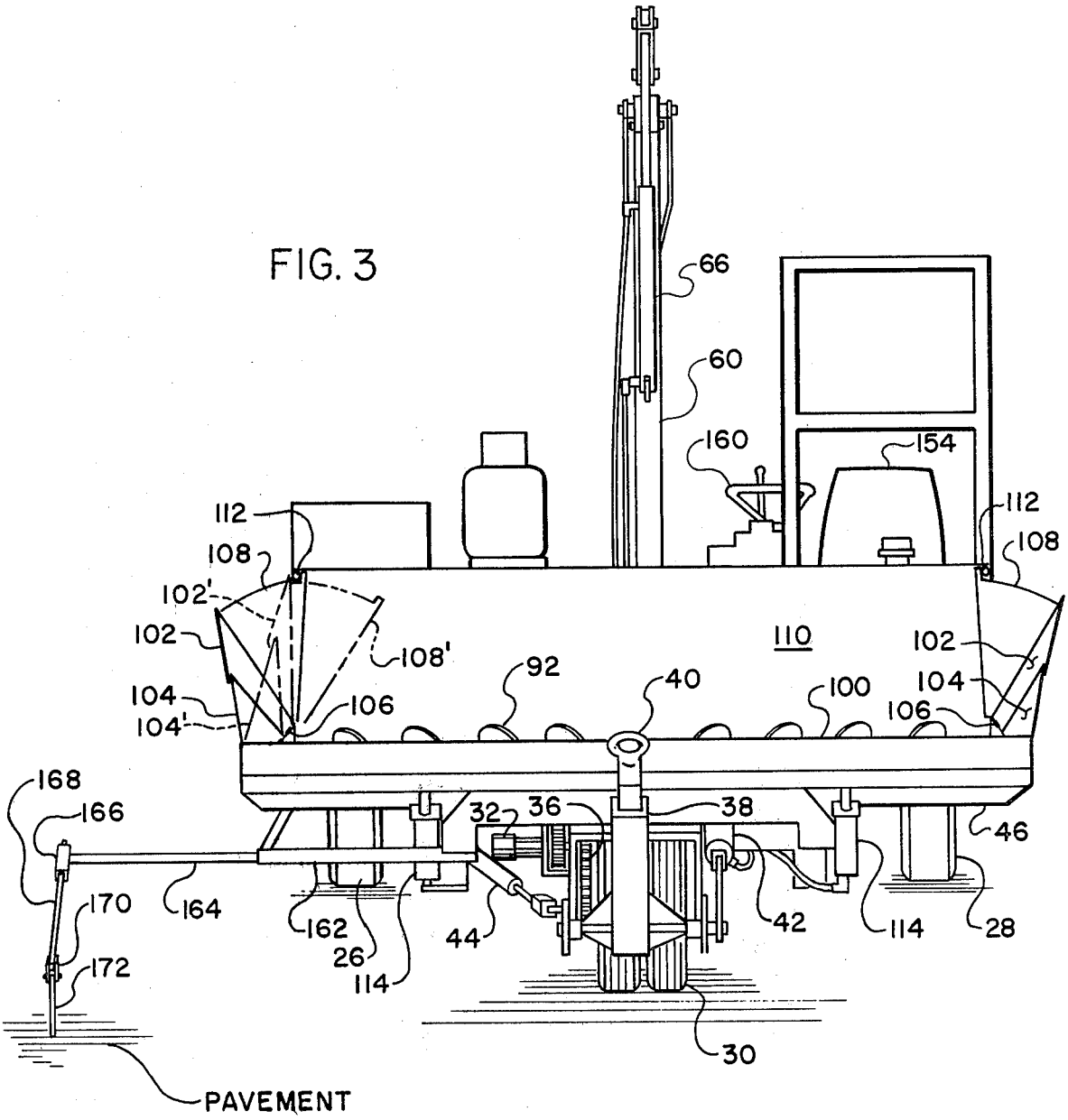
FIG. 3 is a rear view in perspective of the patching apparatus showing the extensible guide in extended position.

This preferred embodiment of the pavement patching apparatus 20 includes hopper means 90 for receiving, containing, and feeding out a supply of patching material, preferably of the hot asphalt type. A double-ended screw conveyor 92 located in the bottom of the hopper 90 extends the full width of the hopper and has opposite-handed screw thread flights extending from each end thereof toward the mid-portion thereof for feeding patching material to a rectangular delivery opening 94 in the bottom of the hopper 90. A hydraulic motor and chain drive (not shown) located under a cover 96 rotate the screw conveyor 92. The hopper 90 has a movable outer wall 98 located at the rear thereof. The wall 98 is hinged at the inner, lower edge thereof and may be placed at a lower position as shown in FIG. 1 for receiving patching material from the dump body D of a truck T as shown in broken lines in FIG. 1, or it may be placed in an upper position as indicated in broken lines at the numeral 98' in FIG. 1. The upper position 98' is suitable for facilitating delivery of the stored patching material to the delivery opening 94. An upstanding rubber lip 100 located at the rear edge of the wall 98 prevents patching material from spilling out of the hopper 90 and is advantageously damage-free. Panels 102 and 104 form the upper side walls of the hopper 90 and have hinges 106 at the lower edges thereof for their attachment to the lower side walls of the hopper 90. The panels 102 and 104 may be manually flipped open to the expanded positions shown in solid lines in FIG. 6, extending beyond the normal road width of the apparatus 20, for secure receipt of patching material from a dump truck body which may normally have the same road width as the apparatus 20. The panels 102 and 104 are telescoping with each other and the panel 102 has gusset-like portions 108 in telescoping relation with the vertical front wall 110 of the hopper means 90. Stops 112 on the front wall 110 limit the travel of the panels 102 and 104. Hopper cylinders 114 are pivotably attached to the frame 46 and the movable outer wall 98 for raising or lowering it. The closed position of the panels 102 and 104 is indicated in broken lines in FIGS. 3 and 6 by the numerals 102' and 104'.

A belt conveyor 116 has its receiving end located beneath the delivery opening 94 and forms a part of the hopper means 90. The conveyor 116 extends from under the opening 94 toward the front or working end of the apparatus 20 and is pivotable about a journal element 118 located under the opening 94 and below the conveyor 116. In its straight forward position as indicated in solid lines in FIG. 6, the conveyor 116 transports patching material delivered thereto from the opening 94 toward the front of the apparatus 20 where the backhoe bucket 72 may be positioned thereunder as shown in solid lines in FIG. 6 and in broken lines at the numeral 72' in FIG. 1 for reception of the patching material into the bucket 72.

Figure 4:
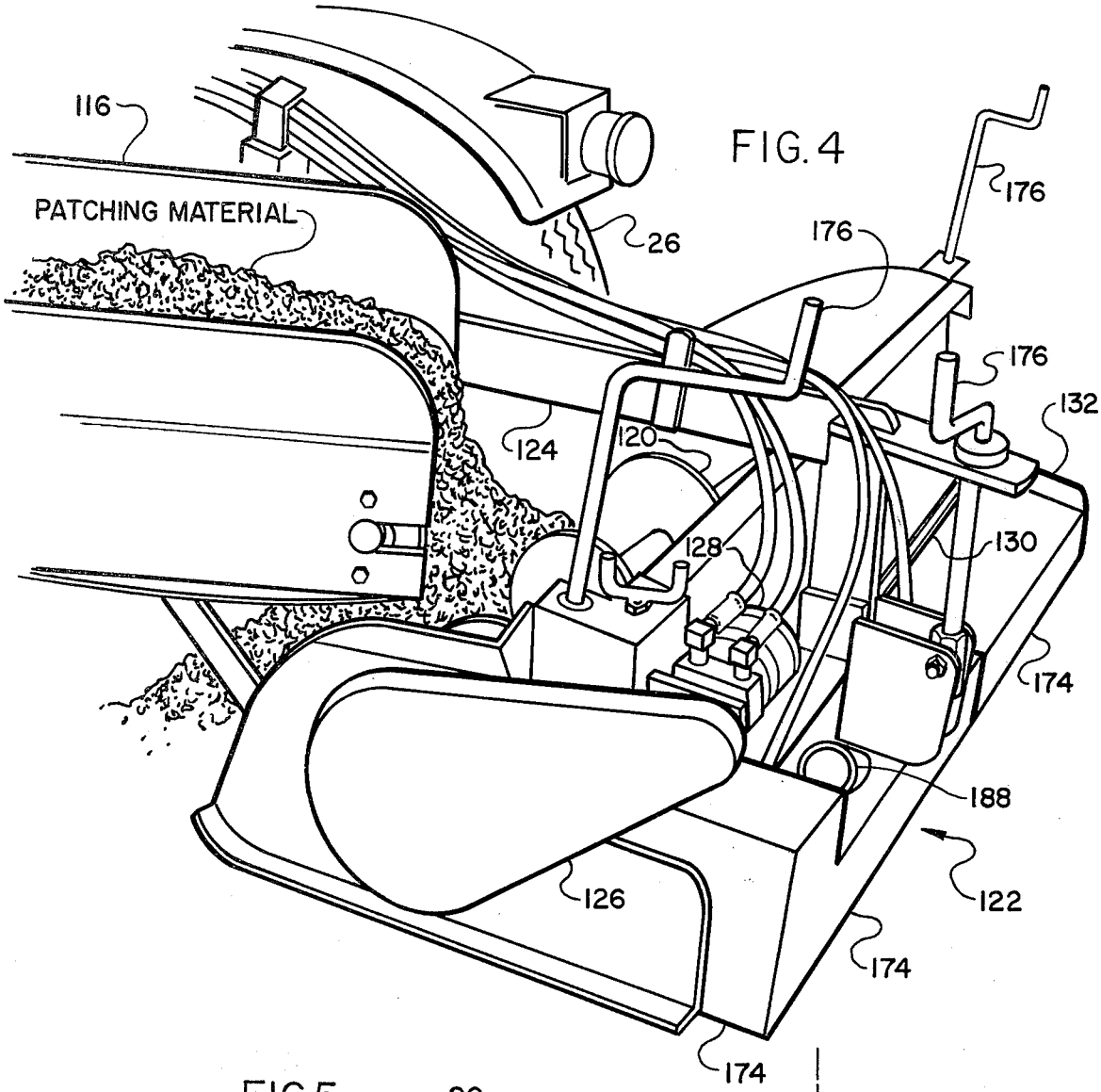
FIG. 4 is a perspective view of the screed means and the conveyor delivering patch material thereto.
Figure 6:
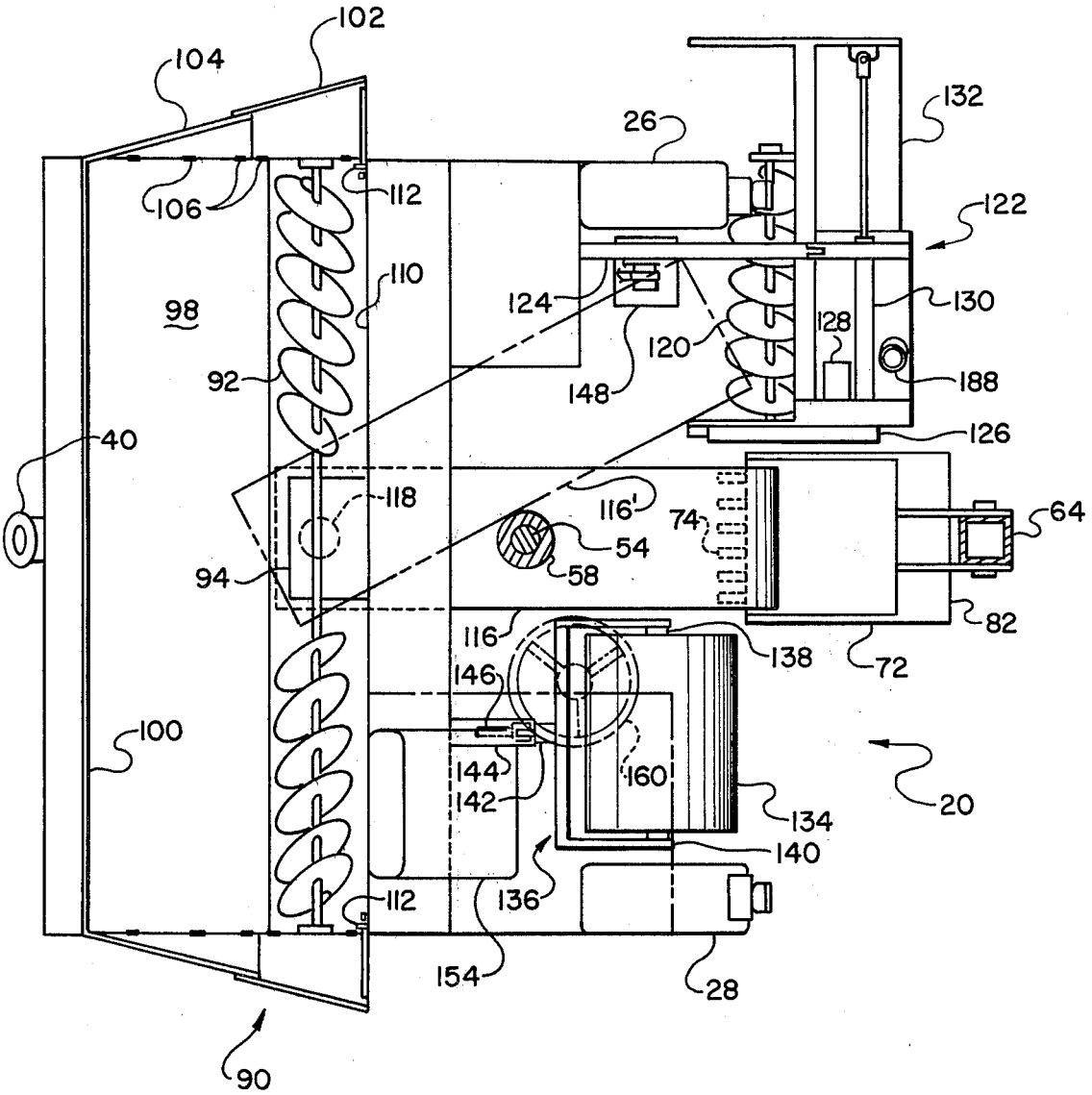
FIG. 6 is a partial plan view of the apparatus taken generally along the line 6—6 of FIG. 1 and showing the backhoe bucket in the position as indicated at 72' in FIG. 1.

Selectively, the conveyor 116 may be manually positioned to an angular location as indicated in broken lines at the numeral 116' in FIG. 6 or as shown in FIG. 4, for delivery of patching material from the delivery opening 94 to a screw conveyor distributor 120 which is part of a screeding means 122 which is supported from the frame 46 by a support arm 124 pivoted therefrom. The screeding means 122 may be raised and lowered from the pavement by action of the outrigger cylinder 152 also linking the support arm 124 to the frame 46. The screw distributor 120 is rotated by a chain drive (not shown) located under a cover 126 and driven by a hydraulic motor 128. The screw distributor 120 is rotated suitably for moving patching material toward the outside of the apparatus 20 as the patching material is delivered thereto from the conveyor 116. The screed means 122 is expandable widthwise by action of the hydraulic cylinder 130 so that its expandable portion 132 extends well beyond the normal road width of the apparatus 20.

A roller 134 is connected to the frame 46 by a yoke member 136 which journals the roller shaft 138 in the yoke arms 140 thereof at one end thereof and is pivotably attached to the frame 46 at the other end thereof. The roller 134 is free to tilt with the irregularities of the pavement because the stem 142 of the yoke arms 140 is free to turn in the bore of a yoke support member 144. A roller cylinder 146 is pivotably connected between the frame 46 and the yoke support member 144 for raising and lowering the roller 134 adjacent the wheel 28.

An outrigger foot 148 is located closely adjacent the left hand wheel element 26 at the inside thereof and is supported from the frame 46 by a drag link 150 which has its ends respectively pivotably connected to the foot 148 and the frame 46. An outrigger cylinder 152 is pivotably connected at its respective ends to the foot 148 and the frame 46 for raising and lowering the foot 148 as desired to clear the foot 148 from the pavement or to force it thereagainst for raising the wheel element 26 therefrom.

A seat 154 is provided as a working position for an operator O for the apparatus 20, and controls for the various power-operated apparatus elements are located thereabout, including a multiplicity of manually operated hydraulic valves 156 which are connected by hydraulic hoses 158 to suitable hydraulic elements. A steering wheel 160 is also located at the operator position.

At the left rear of the apparatus 20 a square tubular bracket 162 is attached to the frame 46 to extend laterally therefrom, and a mating square tubular extension 164 extends through the bracket 162 and therefrom towards the outside of the apparatus 20, terminating in a square tubular crosspiece 166 which in turn carries a square tubular extension piece 168 internally thereof. The extension piece 168 extends rearwardly from the crosspiece 166 and terminates in a clevis end 170 from which depends a swinging arm 172 of suitable length for contacting the pavement, thereby forming an extensible guide for extension rearwardly and widthwise of the hopper 90 beyond the main portion of the apparatus 20 for visibility by the operator O over the hopper 90, enabling the operator O to position the apparatus 20 consistently relative to a pavement feature such as a curbing (not shown).

OPERATION

In operation, the operator O may use the controls provided to steer and maneuver the apparatus 20 backward or forward to locations suitable for repairing pavement defects adjacent to the apparatus 20 and within reach of the backhoe bucket 72. The backhoe bucket may be manipulated to perform its conventional functions of digging at pavement defects with its teeth 74 at the open end of the bucket 72, and additionally by tilting the open end of the bucket 72 upwardly, the blade element 84 will be positioned below the bucket where it can be engaged with the pavement to cut and rip at defective spots to prepare a pavement defect for receipt of patching material and repair.

The bucket 72 may be positioned under the delivery end of the conveyor 116 as shown by the numeral 72' in FIG. 1, for receipt of patching material therefrom. The patching material in the bucket 72 may then be transported to a location over a pavement defect which has been prepared therefor, and the bucket 72 may be manipulated to the position shown in broken lines at the numeral 72'' in FIG. 1 for dumping the patching material on the prepared defect. The piled up patching material may then be leveled off by positioning the bucket 72 with the screed edges 86 parallel to the pavement at a suitable distance thereabove and swinging the bucket 72 across the piled up patched material by action of the cylinder 56. The apparatus 20 may then be maneuvered to place the roller 134 in the vicinity of the leveled patching material, the roller 134 may be lowered to support the weight of the right side of the apparatus 20, and then be used to compact the patched material into and over the defect in the pavement by rolling back and forth over it as desired.

While using the backhoe bucket 72 for digging, cutting, scraping, etc. it is desirable to remove the weight of the apparatus 20 from the wheel elements 26 and 28 (which are conventionally spring-suspended) to provide a solid platform for the backhoe operation. This may be readily accomplished by extending the roller cylinder 146 and the outrigger cylinder 152 suitably for forcing the roller 134 and the outrigger foot 148 into engagement with the pavement whereby the two elements 26 and 28 will be raised from the ground so that the front end of the apparatus 20 is supported on the roller 134 and the outrigger foot 148 for maximum stability.

Where extensive areas of pavement are to be prepared, it may be desirable after suitable preparation of the defect with the backhoe bucket 72, to use the screeding means 122 for distribution of patching material onto the defective pavement area and for leveling off the patching material. The apparatus 20 should be moved and maneuvered to a location where the screeding means 122 is located over one end of a defective area such that the apparatus 20 may be moved in reverse to move the screeding means 122 over the complete length of the defective pavement area while transporting patching material from the delivery opening 94 of the hopper means 90 on the conveyor 116 to deliver the patching material to the screw conveyor distributor 120 of the screeding means 122, the screeding means 122 having been expanded to its full width if desired and having been lowered to operating position and its screeding skirts 174 having been adjusted to suitable height above the pavement by means of the adjusting cranks 176. Then, the apparatus 20 may be moved in reverse with the patching material being fed to the screed means 122 and the patching material will be distributed over the width of the screed means 122 by the distributor 120 while the patching material will be leveled off over the pavement defect to a uniform height by the action of the screeding skirts 174 as they are dragged over the pile of patching material.

Figure 5:
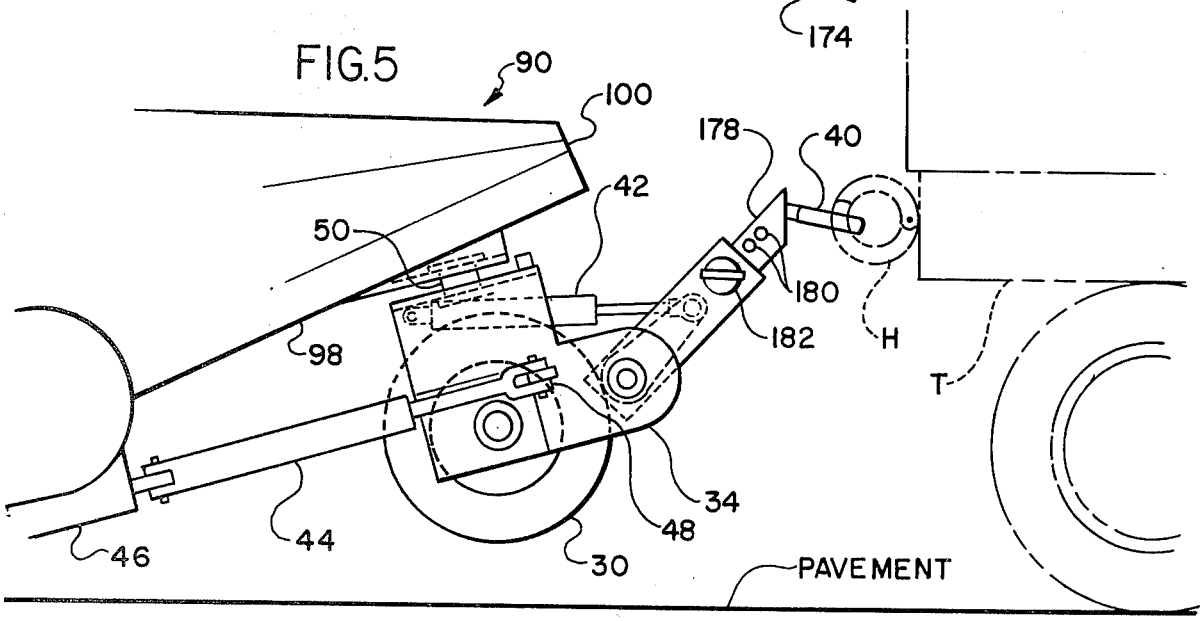
FIG. 5 is a partial left side elevational view of the rear portion of the apparatus showing it hitched to a truck for towing.

Upon completion of a pavement patching job in a general area, when it becomes desirable to move the apparatus 20 to a different area, it is only necessary to position a truck T having a hitch hook H as shown in FIG. 1, whereupon the towing link 38 may be lowered and extended so that the tow eye 40 engages the hook H as shown in FIG. 5, thereby lifting the third wheel element 30 from the ground and making the apparatus 20 ready for towing on its free-turning wheel elements 26 and 28. The shank 178 of the tow eye 40 has a number of holes 180 spaced therealong for engagement by a locking pin 182 for adjustably positioning the tow eye 40 suitably for engagement with a hitch hook H.

Extension of the towing link 38 automatically gives more clearance between the apparatus 20 and the truck T for making turns during the course of towing the apparatus 20, but it is further desirable that the movable outer wall 98 of the hopper means 90 should be in its upper position as indicated by the numeral 98' in FIG. 1 for maximum clearance for such turning.

A tack oil tank 184 is located adjacent the front vertical wall 110 of the hopper means 90. A duct 186 is provided for blowing hot gases from a conventional gas burner (not shown) through the tack tank 184 to keep the tack oil hot. Similarly, a duct 188 is provided in the screeding means 122 for introducing hot gases thereinto.

Although a variety of pavement patching apparatus is available in the prior art, it appears that the versatility and maneuverability of the combination of the present invention is highly advantageous, in that the apparatus 20 is self-propelled and may be moved about under its own power at a walking speed for movement from patch to patch, and at a much slower speed for spreading and screeding patched material with the screeding means 122. There is no need to tie up a truck or other prime mover for use of the apparatus 20 in patching, and there is none of the awkwardness of coordinating the efforts of two operators where a non-self-propelled patching apparatus is used. The backhoe is an ideal apparatus for preparing patches for repair, but heretofore it has been a separate piece of equipment and other equipment and other operators were required for applying patch material and for screeding and rolling the patched material. The apparatus of the present invention thus provides the ideal instrument for repairing defective pavement for patching, and combines with it an integral patch material supply, alternative means of supplying patch material to large and small repairs, means for distributing the patch material accurately and smoothly over a prepared patch area, and a roller for putting the final compaction and finish on the patch.

The apparatus 20 of the present invention appears to combine the essential means for quick, efficient, economical pavement repair with a maximum crew of three men, while a conventional pavement repair crew requires eleven men to accomplish not as much patching as the three man crew needed with the present invention. Provision of towing means allows the self-propelling elements of the apparatus 20 to be relatively small and inexpensive, since only comparatively slow movement is needed for patching and for mobility around an individual job site for making multiple patches. The engine 22 is thus a relatively small air-cooled engine, the prime mover for the over-the-road travel may be any commercially available truck with a trailer hitch-hook, and the many complications in meeting regulatory standards for self-propelled over-the-road travel are avoided.

The elements of the present invention might be combined in many alternate configurations other than that disclosed in the present description and drawings, and the particular embodiment disclosed in full detail herein and illustrated in the drawings has been provided for disclosure purposes only and is not intended to limit the scope of the present invention, which is to be determined by the scope of the appended claims.

I claim:

1. Pavement patching apparatus of the type that is movable to locations for repairing pavement defects adjacent said locations, said apparatus comprising hopper means for containing a supply of patching material; backhoe means mounted on said apparatus and having a bucket; and means mounted on said apparatus for operating said backhoe means to manipulate said backhoe bucket to position said backhoe bucket selectively at said hopper means and at pavement defects, to manipulate said backhoe bucket at pavement defects for working on pavement defects in preparation for receipt of patching material, to position said backhoe bucket to receive patching material from said hopper means, and to manipulate said backhoe bucket to dispense patching material therefrom onto prepared pavement defects.

2. Pavement patching apparatus according to claim 1 and characterized further by a blade element located adjacent the closed end of said bucket and connected thereto for said working on pavement defects.

3. Pavement patching apparatus according to claim 1 or 2 and characterized further by at least one screeding edge on said bucket extending generally from the closed end to the open end thereof along the underside thereof for use of said bucket in leveling off patching material dispensed to said prepared pavement defects.

4. Pavement patching apparatus according to claim 1 and characterized further by said hopper means having a portion for storage of said supply of patching material and conveyor means for transporting said patching material from said storage portion for use in repairing pavement defects.

5. Pavement patching apparatus according to claim 4 and characterized further in that said hopper has a movable outer wall for lowering to a suitable location for reception of patching material from a dump truck and for raising to a location suitable to facilitate delivery of said patching material onto said conveyor.

6. Pavement patching apparatus according to claim 1 and characterized further by screeding means supported on said apparatus for movement thereby for leveling off patching material over pavement defects.

7. Pavement patching apparatus according to claim 6 and characterized further by said hopper means having a portion for storage of said patching material and conveyor means for transporting said patching material from said storage portion, said conveyor means being movable between positions for feeding patching material selectively into said backhoe bucket and said screeding means.

8. Pavement patching apparatus according to claim 1 and characterized further by outrigger means, a roller for compacting patching material over pavement defects, and wheels for moving said apparatus to said locations for repairing pavement defects, said outrigger means comprising a movable pavement-engaging foot and means for lowering said foot adjacent one of said wheels for lifting said wheel from said pavement and means for lowering said roller into pavement engaging position adjacent another of said wheels for lifting said another wheel from said pavement.

9. Pavement patching apparatus according to claim 1 and characterized further in that said apparatus has at least three wheels for moving said apparatus to said locations for repairing pavement defects, and a towing link pivotably mounted at one end thereof to said apparatus adjacent to one of said wheels, said link having at the other end thereof an eye for engagement with a trailer hitching hook on a truck, said link being pivotable upwardly to a location for convenient engagement of said eye with said hook while said one wheel rests on said pavement and being pivotable downwardly after such engagement for lifting said wheel from said pavement for towing said apparatus behind a truck.

10. Pavement patching apparatus according to claim 1 and characterized further in that said hopper is expansible widthwise of said apparatus beyond the normal road transport width thereof for secure receipt of patching material from a dump truck.

11. Pavement patching apparatus according to claim 1 and characterized further by having a work position for an apparatus operator, where an operator normally sits and operates a steering wheel and other controls for the apparatus, said hopper being located to the rear of said work position, and by an extensible guide mounted on said apparatus for extension rearwardly and widthwise of said hopper beyond the main portion of said apparatus for visibility by said operator over said hopper, said guide having a depending arm for contact with said pavement so that said operator is enabled to position said apparatus consistently relative to a pavement feature such as a curbing.

* * * * *